United States Patent [19]

Baril

[11] 4,196,491

[45] Apr. 8, 1980

[54] CONTROLLABLE PAINT ROLLER

[76] Inventor: Conrad J. Baril, 12529 S. Truro Ave., Hawthorne, Calif. 90250

[21] Appl. No.: 896,466

[22] Filed: Apr. 14, 1978

[51] Int. Cl.[2] ..... B05C 17/02

[52] U.S. Cl. ..... 15/230.11; 15/144 B

[58] Field of Search ..... 15/27, 143 A, 144 B, 15/230.11, 248 A; 401/25, 147, 197, 208, 218, 219

[56] References Cited

U.S. PATENT DOCUMENTS

| | | | |
|---|---|---|---|
| 1,645,357 | 10/1927 | Skrzeczkowski | 15/27 UX |
| 2,702,917 | 3/1955 | Lynden | 15/230.11 |
| 2,949,620 | 8/1960 | Noble | 401/219 X |
| 3,408,676 | 11/1968 | Cayo | 15/230.11 |
| 3,916,470 | 11/1975 | May | 15/230.11 |
| 3,977,797 | 8/1976 | Paterson | 401/197 X |

FOREIGN PATENT DOCUMENTS

| | | | |
|---|---|---|---|
| 542335 | 11/1955 | Belgium | 15/230.11 |
| 796002 | 10/1968 | Canada | 15/144 A |
| 1103324 | 5/1955 | France | 15/230.11 |
| 75481 | 8/1949 | Norway | 15/144 B |
| 44260 | 1/1909 | Switzerland | 15/230.11 |
| 1353027 | 5/1974 | United Kingdom | 15/230.11 |

*Primary Examiner*—Philip R. Coe
*Attorney, Agent, or Firm*—Singer & Singer

[57] ABSTRACT

This invention relates to an improved paint roller in which the cylindrical body adapted to support a cylindrical paint applicator is controlled by a locking control on the handle for interrupting the rotation of the cylindrical paint applicator. By making the applicator pivotably adjustable with respect to the handle and controlling the rotation of the applicator, it is now possible to use the paint roller in the same fashion that a conventional brush applicator is used. Complete control of the application of paint is achieved by allowing the applicator to rotate a selected portion by means of the locking control on the handle.

7 Claims, 5 Drawing Figures

Fig. 1.
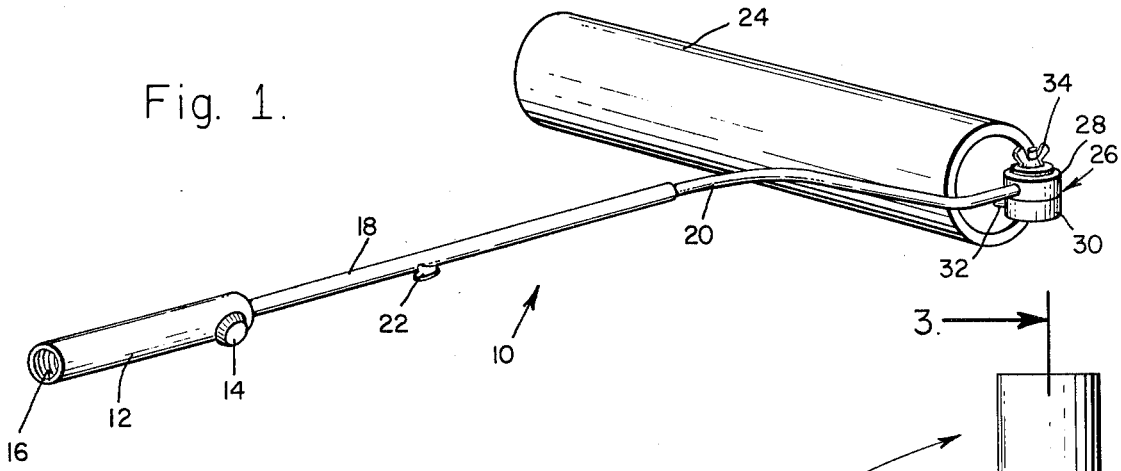
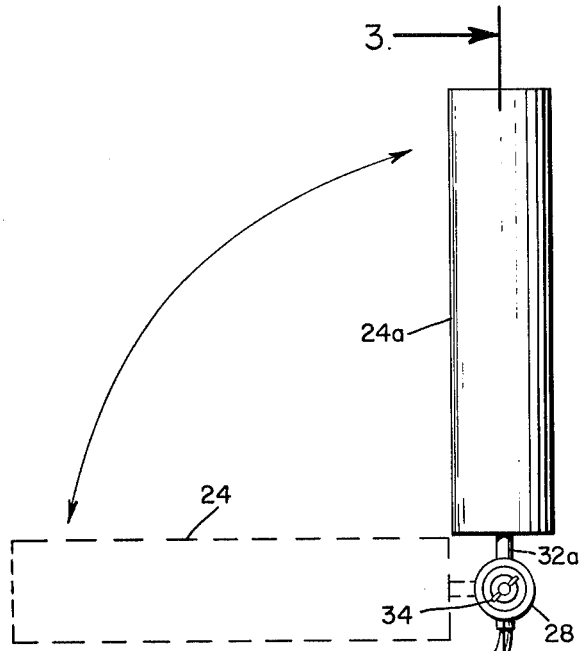
Fig. 3.
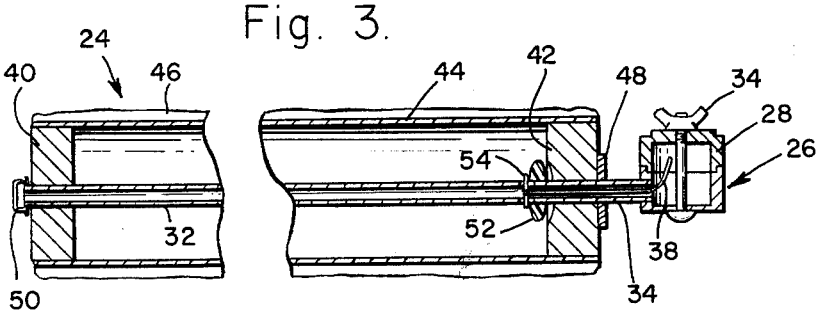
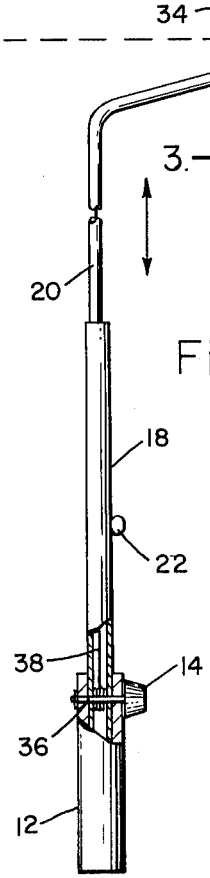
Fig. 2.
Fig. 4.
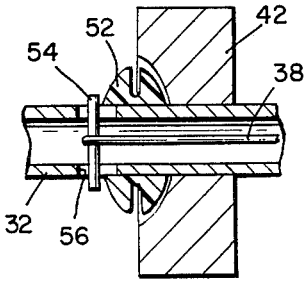
Fig. 5.
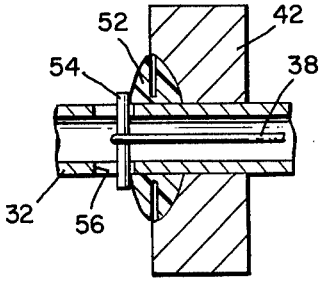

CONTROLLABLE PAINT ROLLER

This invention relates to a controllable paint roller in which the rotatable paint applicator is prevented from rolling by means of a locking control on the handle.

In the art of applying paint, the biggest advance since the development of the paint brush has been the paint roller.

In operation, the paint roller is immersed in a source of paint and rotated in the paint so as to cover the complete cylindrical surface of the paint roller. The operator then applies the paint roller to the wall or other surface so as to distribute the paint to the wall in a rolling motion from the paint roller to the wall or surface.

The paint roller is extremely satisfactory for broad surfaces and has found wide acceptability in applying broad areas of paint. However, the paint roller does have serious drawbacks when approaching corners, between walls, and corners between the ceiling and the wall. In particular the paint roller also has problems in distributing the paint near areas of molding that protrude from the wall.

It is common practice to use the paint roller for the broad expansive areas and to use the paint brush in the areas of molding and corners between wall and wall and ceiling of wall.

Similar problems exist in the use of rollers in corners where wall meets wall and from the middle of rooms where molding surrounds a door and protrudes from the wall. The use of a roller is considered inappropriate because of the lack of control over the amount of paint on the roller when approaching the corner areas. It has been discovered that the applicator either contains too much paint which then flows into the opposite wall or unduly marks the molding when it is only the wall that is intended to be painted.

The common practice in the trade is to use either masking tape to protect the wall or molding or alternatively to use guides that are interposed between the paint roller and the wall or molding so as to protect the opposing wall and molding from being splattered by the excess paint invariably associated with the paint roller.

The present day alternatives also include the use of a hand brush which provides the necessary control in the application of paint to the restrictive and difficult portions associated with molding and corner applications.

In the present invention the defects of the present day paint roller have been eliminated by giving to the painter additional control over the application of the paint to the wall.

In the preferred embodiment there is disclosed a locking control on the handle which is connected by means of a cable to the freely rotating rollers supporting the cylindrical paint applicators. By rotating the locking control the cable is pulled tight and the paint roller is prevented from rolling in the conventional free-wheeling manner.

In this configuration the paint roller does not rotate and the operator by moving the applicator in a variable up and down motion is now free to apply paint from a fixed portion of the roller to the wall until the allowable paint has been distributed to the satisfaction of the user. By freeing the locking control the paint roller is allowed to rotate a given amount to expose additional paint for application to the wall, at which time the locking control is then energized to lock the roller in position to thereby repeat the process until all paint on the roller has been satisfactorily applied to the wall.

In this fashion the painter is free to select how much paint is applied at any given time to the wall which is highly desirable when in crowded positions such as in the corner between wall and wall and near molding so as to prevent excess paint from being applied indiscriminately.

In the conventional paint applicator the roller is located orthogonally with respect to the handle and the paint roller is expected to be used in a vertical up and down motion.

Due to the diameter of the roller there always exists a small area between the ceiling and the wall where the paint roller is not capable of reaching and this area must always be touched up by hand with a conventional paint brush.

In the present invention the cylindrical body normally located orthogonally with respect to the handle is made adjustable so that the rotatable roller can be varied from the orthogonal position to a parallel position, thereby allowing the paint roller to be off-set but parallel with the handle. In this fashion the painter can now apply paint directly to the wall at the intersection between the ceiling and the wall without the need of a conventional paint brush to fill in the corner.

By utilizing the locking control on the handle in combination with the pivotable feature, the painter can now apply paint to the corner at the intersection between the ceiling and the wall and in a fashion that has not heretofore been possible before the advent of the present invention.

Further objects and advantages of the present invention will be made more apparent by referring now to the accompanying drawings wherein:

FIG. 1 is a perspective view illustrating a paint roller constructed according to the principles of this invention;

FIG. 2 illustrates a top view of the paint roller illustrated in FIG. 1 and further showing the adjustable positions for the paint roller relative to the handle;

FIG. 3 is a section taken along lines 3—3 of FIG. 2;

FIG. 4 is an enlarged view of the roller locking device in an unenergized position; and FIG. 5 is an enlarged view of the roller locking device in an energized position.

Referring now to FIG. 1, there is shown a controllable paint roller 10 comprising a handle portion 12 having a locking control 14 located at one end.

The opposite end of the handle 12 contains an internally threaded portion 16 adapted to accept an extension handle for extending the paint roller in a fashion that is well known in the art today.

Located at the opposite end of handle 12 is an extension tube 18 containing a telescoping tube 20 having a reduced diameter and adapted to be inserted within tube 18. A locking screw 22 located on tube 18 is adapted to lock the position of the telescoping tube 20 as determined by the user.

The telescoping tube 20 contains a ninety degree bend and is connected to a paint roller 24 through an adjustable pivotable connection 26.

Pivotable connection 26 comprises a first channel 28 fixedly attached to telescoping tube 20 and a second channel 30 fixedly attached to an axle 32 upon which the paint roller 24 is adapted to rotate. Channels 28 and 30 are frictionally engaged and held in position by a locking nut 34 which is easily loosened to change the angle of the paint roller 24 with respect to the telescoping tube 20.

The paint roller 10 is typically used with the paint roller 24 located orthogonally with respect to the handle 12 as illustrated. In this fashion the paint roller is used in the conventional manner.

Referring now to FIG. 2, there is shown a top view of the controllable paint roller 10 which illustrates how the paint roller 24 may be moved from an orthogonal position with respect to handle 12 to a parallel but offset position as illustrated by 24*a* by loosening wing nut 34.

With the cylindrical paint applicator in the position as shown at 24*a*, the painter may now apply paint directly to the junction between the ceiling and the wall without need of utilizing a conventional paint brush and by using the same techniques when painting the junction between wall and wall at a corner.

FIG. 2 also shows a cutaway portion on handle 12 and in the area of the locking control 14 to show that the locking control includes a pin 36 connecting a cable 38 that is located within handle 18 and telescoping portion 20. The function of the locking control 14 is simply to rotate and pull the cable 38 or to release cable 38 in accordance with the desire of the user should he require that the paint roller 24 be allowed to rotate or not rotate.

Referring now to FIG. 3, there is shown a cross-section taken along lines 3—3 of FIG. 2 and which more fully illustrates the construction of the roller 24.

FIG. 3 illustrates axle 32 fixedly attached to channel 30 and wing nut 34 fixedly holding channels 28 and 30 together in a preferred position.

Located on axle 32 is a paint roller 24 consisting of a pair of rollers 40 and 42 covered by a cylinder 44 which in turn is covered by a suitable paint applicator 46.

The complete assembly of the paint roller is inserted on the axle 32 and positioned against a first washer 48 which limits the movement of the paint roller in one direction. The paint roller is locked in position on the axle 32 by means of clip 50.

Located on the inside of the paint roller 24 and bearing against the inside face of paint roller 42 is a rubber grommet 52 that is preferably physically attached to axle 32. A pin 54 is located transversely in the axle 32 and is centrally attached by means of cable 38 which is also connected through channels 26 and 28 through telescoping portion 20 and extension 18 and which finally terminates in pin 36 attached to the locking control 14 on handle 12 as shown in FIG. 2.

In operation rotating locking control 14 causes pin 36 to rotate which wraps one end of cable 38 around the pin thereby drawing the cable tight as the locking control is rotated. The tight cable 38 pulls on pin 54 which is permitted a small movement against grommet 52 which bears against the inside surface of roller 42 thereby interrupting the rotation of the paint roller 24.

Referring now to FIG. 4, there is shown an exploded view of roller 42 showing how the roller 42 rotates in the normal operation.

Pin 54 is located in axle 32 in slot 56 which allows the pin to ride free of the grommet 52 when cable 38 is slacked.

Referring now to FIG. 5, there is shown the effect of locking control 14 putting tension on cable 38 so as to pull pin 54 against grommet 52. In this fashion the grommet 52 is compressed against the inside surface of roller 42 thereby effectively preventing roller 42 from rotating so as to prevent the paint roller 24 from rotating.

Releasing the locking control 14 allows the cable 38 to go slack which in turn causes pin 54 to relax and move back into the clearance provided by opening 56 so that grommet 52 may expand and allow roller 42 to again rotate.

In this fashion the painter can apply paint to the roller in the conventional manner but now can completely control the rate at which the paint is applied to the wall by selectively limiting the rotation of the paint roller as the roller is moved up and down or across the wall. The amount of paint dispensed to the wall is now controlled and close precision work in the corners between wall and wall and between ceiling and wall can now be effectively encompassed by a single paint applicator.

I claim:

1. An improved paint roller comprising:
   - an elongated member,
   - a non-rotatble axle rotatably attached to one end of said elongated member,
   - a handle movably attached to the other end of said elongated member,
   - a pair of rollers and a cylindrical body covering said pair of rollers rotatably mounted on said axle, said cylindrical body adapted to support a cylindrical paint applicator, and
   - a locking control located on said handle and being directly connected with one of said rollers for interrupting the rotation of said cylindrical body.

2. A paint roller according to claim 1 in which said handle includes an extension member having a central opening therein for accepting a portion of said elongated member.

3. A paint roller according to claim 1 in which said axle is adjustably attached to said elongated member for varying the angle of said cylindrical body with respect to said elongated member.

4. A paint roller according to claim 3 in which said adjustable attachment comprises a pair of adjacent channels held together in a friction bearing relationship by a locking screw and in which said elongated member is attached to one of said channels and said axle is attached to the other of said channels.

5. A paint roller according to claim 1 which includes a controllable braking device consisting of a flexible non-rotating grommet located on said axle adjacent one of said rollers and adapted to be forced into contact with said roller by said locking control for braking said roller.

6. A paint roller according to claim 5 which includes a pin mounted transverse in said axle adjacent the other side of said grommet and movable in an axial direction by said locking control to force said grommet against said roller.

7. A paint roller according to claim 6 which includes a cable attached at one end to said pin and at the other end to said locking control whereby rotating said locking control pulls said cable and forces said pin axially into said grommet to prevent said roller from rotating.

* * * * *